United States Patent [19]

Mills

[11] Patent Number: 4,948,054

[45] Date of Patent: Aug. 14, 1990

[54] PNEUMATIC DRYWALL TEXTURE BAZOOKA

[75] Inventor: Gregory B. Mills, Santa Ana, Calif.

[73] Assignee: Behr Process Corporation, Santa Ana, Calif.

[21] Appl. No.: 319,959

[22] Filed: Mar. 7, 1989

[51] Int. Cl.[5] ..... B05B 7/14

[52] U.S. Cl. ..... 239/325; 239/346; 239/347; 239/366; 239/369; 239/373

[58] Field of Search ..... 239/346, 347, 364, 365, 239/366, 368, 369, 371, 372, 373, 325, 143, 654; 222/175, 397, 630; 406/38, 146, 151, 153

[56] References Cited

U.S. PATENT DOCUMENTS

| | | | |
|---|---|---|---|
| 1,566,325 | 12/1925 | Hansen | 239/371 |
| 2,625,433 | 1/1953 | Vose | 239/347 |
| 2,886,252 | 5/1959 | Ehrensperger | 239/364 |
| 3,236,459 | 2/1966 | McRitchie | 239/371 |

*Primary Examiner*—Andres Kashnikow

*Assistant Examiner*—Karen B. Merritt

*Attorney, Agent, or Firm*—Morland C. Fischer

[57] ABSTRACT

A low cost, hand-held sprayer that is pneumatically powered so that a wall or ceiling may be textured. The sprayer includes a hollow J-shaped body that is filled with a liquid texture material. An air passage communicates with an air supply and extends through the sprayer body to deliver respective streams of air to an exit orifice at the bottom of the body and to an air chamber at the top of the body. An air escape hole is formed through the sprayer body to communicate with the air chamber at a location above the material supply. By manually closing the air escape opening, a positive air pressure is created within the air chamber to force the entire column of material towards the exit orifice at the bottom of the sprayer body. Accordingly, air from the air passage is mixed with material and injected through the exit orifice to thereby discharge and atomize the material.

3 Claims, 3 Drawing Sheets

PNEUMATIC DRYWALL TEXTURE BAZOOKA

BACKGROUND OF THE INVENTION

1. Field of the Invention

This invention relates to a portable spraying device that allows drywall texturing of a surface without resorting to expensive, elaborate and cumbersome pumps to deliver the viscous texture material.

2. Background Art

Due to the nature of drywall ceiling texture materials, consisting of a highly viscous fluid with particulate matter in homogeneous suspension, conventional spraying devices are undesirably limited due to the separation of the liquid base material from its particulate matter. Such stratification may cause the undesirable clogging of the spray tip. Moreover, the changing ratio of the liquid and particulate material during spraying may contribute to an uneven texture.

Conventional drywall texture sprayers are, for the most part, large motor engine driven fluid pumps with an air compressor to supply air to atomize the texture material at a spray tip. Large spray rigs ordinarily have a mixing tank built therein. Hoses are included to channel air and material, under pressure, to the spray tip where the air and material are forcibly discharged through an orifice at the tip of a gun, or the like.

Hand texture rigs include either a revolving series of flippers that flip the particles and base viscous liquid, gravity fed hoppers with a spray gun mounted at the bottom, or a hand pump device which is gravity or suction fed. Hopper type sprayers which use gravity to feed the material to the spray tip gun tend to jam up due to the lighter particulate matter, in acoustic ceiling mix, separating from the liquid portion under the influence of suction at the bottom of the hopper. The particles also tend to rise due to their tendency to float during the liquification of the viscous base liquid. Acoustic ceiling texture material is normally styrofoam grains in a vinyl glue and gypsum power base mixed with water.

The aforementioned conventional sprayers are generally complex, expensive and difficult to operate for casual use. Therefore, it would be desirable to provide a low cost, simple device which would allow the spraying of drywall texture without the liquification and stratification problems that are known to occur in such conventional spraying devices.

SUMMARY OF THE INVENTION

In general terms, a portable sprayer powered only by an air supply is disclosed by which to apply drywall texture materials. The sprayer includes a hollow, cylindrical J-shaped body having a rounded bend near the bottom. The lower portion of the sprayer body has a smaller diameter than the upper portion. The opposite ends of the sprayer body have removeable caps. The top end of the body has a cap to contain the drywall material and create a closed chamber in which to pressurize the material. The bottom end of the body has a cap with a hole therein to create an exit orifice to control and atomize the material. This cap may be replaced with a cap having a different sized orifice for different requirements of differing textures. At the top of the sprayer body, there exists an air escape hole of sufficient size to allow the escape of air, whereby to prevent the pressurization of the closed chamber above the material. The sprayer is operable only upon the controllable action of the operator when the air escape hole is intentionally blocked. An air supply conduit, including a splitting tee, extends through the sprayer body for delivering streams of air from an air supply to the top and bottom of said body.

In operation, the top cap of the sprayer body is removed. Mixed texture material is poured into the sprayer body leaving a small air pocket at the top of the sprayer. The sprayer is held approximately three feet from the surface to be sprayed. The operator places his finger over the air escape hole to create a closed air chamber with increasing pressure due to the exhaust of pressurized air that is delivered to the chamber via the air supply conduit. The pressure within the chamber is controllably greater than the outside air pressure, resulting in the movement of the viscous material downwardly through the sprayer body and outwardly through the exit orifice where the material is dispersed and atomized for proper texture patterns. When the air escape hole is covered and the air chamber is pressurized, the air flow into said chamber at the top of the sprayer body is reduced, and the majority of the air flow is diverted to the exit orifice at the bottom of the sprayer body. This results in proper atomization of the material with a relatively small air compressor as the air supply. When the sprayer body is empty, the operator disconnects the air supply and refills the body with material for further use.

DESCRIPTION OF THE PREFERRED EMBODIMENT

Figure 1:
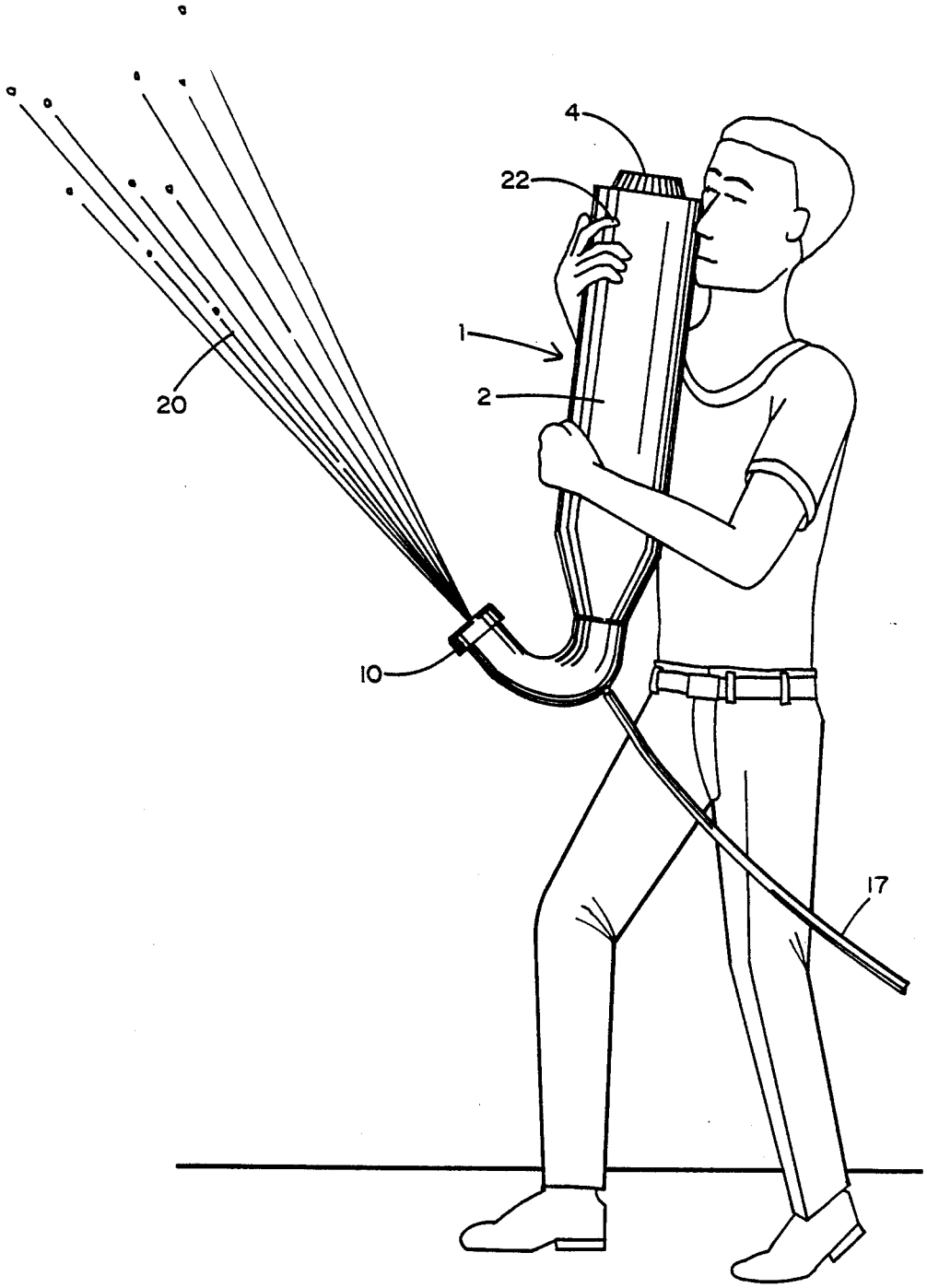
FIG. 1 is illustrative of an operator using the portable, pneumatic sprayer of the present invention to spray drywall texture onto a ceiling.
Figure 2:
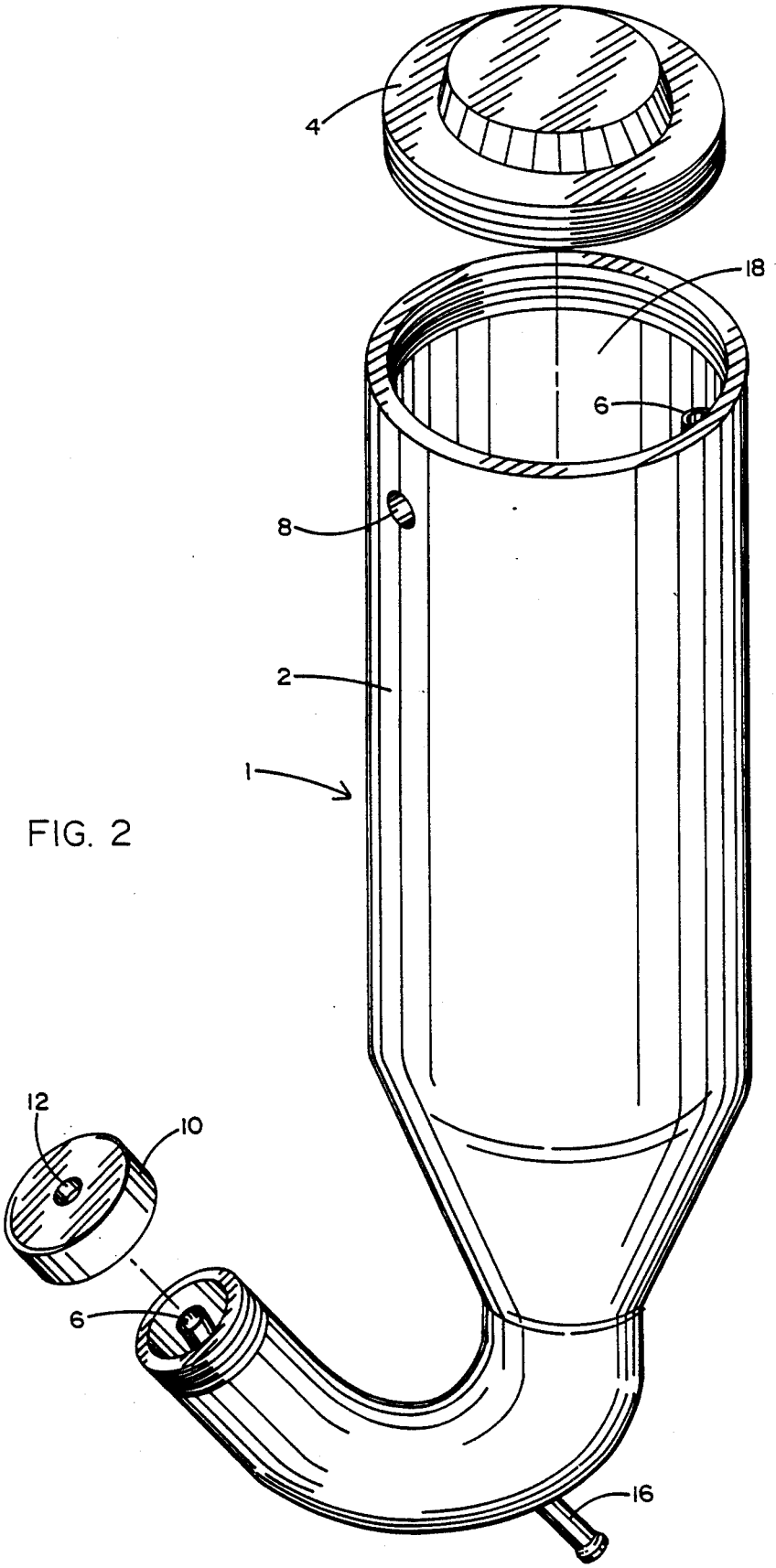
FIG. 2 is a perspective view of the sprayer of FIG. 1 showing removable top and bottom end caps.
Figure 3:
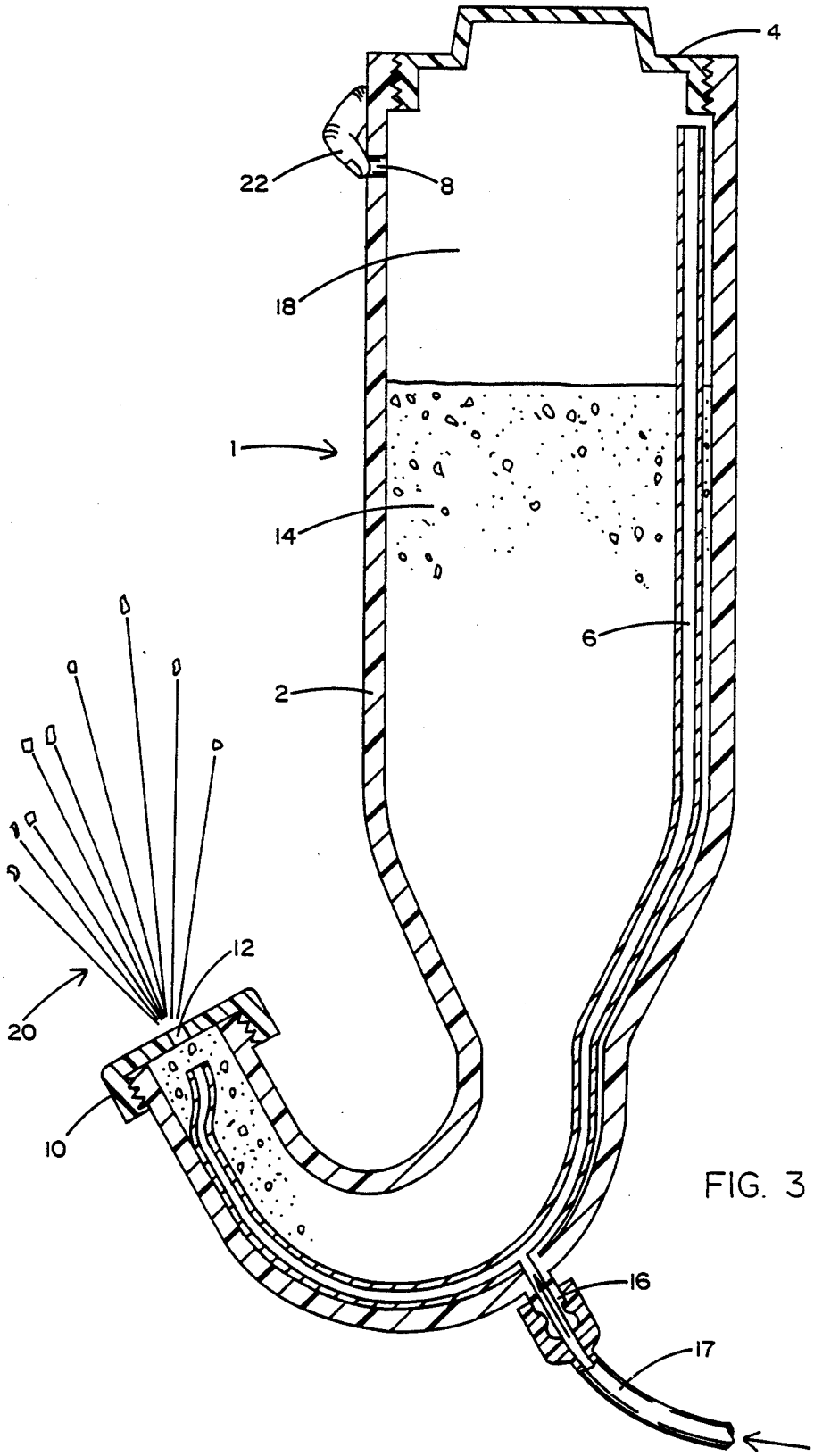
FIG. 3 is a cross-section of the sprayer of FIG. 2.

The portable, pneumatic sprayer 1 which forms the present invention is described while referring concurrently to FIGS. 1–3 of the drawings. Sprayer 1 includes a hollow, cylindrical J-shaped body having a rounded bend near the bottom. The lower portion of the sprayer body 2 has a smaller diameter than the upper portion thereof. The sprayer body 2 is preferably injection molded into the illustrated shaped and size. A screw-off material cap 4 is removably affixed to the top of the sprayer body 2 to permit the sprayer 1 to be filled with a supply of texture material 14, and a screw-off spray cap 10 is removably affixed to the bottom of the body 2 from which the material is to be sprayed. An air escape hole 8 (of FIGS. 2 and 3) extends through sprayer body 2 near the top thereof to release trapped air from an air chamber 18 and thereby enable a controllable discharge of dry wall texture material to be sprayed onto a wall or ceiling (best shown in FIG. 1). An exit orifice 12 is formed through spray cap 10 and located directly above one end of an air passage 6 which extends through sprayer body 2. The opposite end of air passage 6 terminates within the air chamber 18. An air intake nipple 16 communicates at a tee with air passage 6 through sprayer body 2 and is adapted to be connected to a standard air hose 17, so that a supply of air, under pressure, can be delivered from a source thereof to passage 6.

In operation, the air supplied to air passage 6 from hose 17 is split into two streams. One air stream is conducted by air passage 6 to the air chamber 18 at the top of the sprayer body 2. When the air escape 8 is open, the air supplied to chamber 18 escapes through said hole, and no material is sprayed. When the operator places his finger 22 over the air excape hole 8 to close said hole, a positive air pressure is built up in air chamber 18 above the material 14 to be sprayed. Hence, the material 14 within sprayer body 2 is hydraulically forced (with a potential mechanical advantage) towards the spray cap 10 at the bottom of sprayer body 2. That is to say, the entire column of material 14 within sprayer body 2 is simultaneously forced downwardly toward exit orifice 12 without liquification and stratification and consequent clogging of such orifice, as is otherwise common to all other known powered texture spraying devices.

The second air stream is conducted by air passage 6 towards the spray cap 10 at the bottom of the sprayer body 2. The cap 10 has an exit orifice 12 which is dimensioned so as to expand and atomize the material 14 within sprayer body 2. The material 14 flows into the path of the second air stream at the bottom of body 2. The combination of pressurized material 14 and the explosive expansion of the air being injected through exit orifice 12 creates an atomized spray 20 which is suitable for texturing drywall.

The portable sprayer of the present invention allows the controllable spraying of homogeneous drywall ceiling and wall textures without the inconvenience and blockages that are due to stratification and liquification of the viscous base material and the lighter particulate matter. Thus, the sprayer will be particularly useful for patchwork and by homeowners and handymen for room additions and remodeling applications.

It will be apparent that while a preferred embodiment of the invention has been shown and described, various modifications and changes may be made without departing from the true spirit and scope of the invention.

Therefore, what is claimed is:

1. A portable spraying apparatus form spraying a homogeneous material comprising a hollow substantially cylindrical, J-shaped body having a top, first end and a lower, second end;

a removable first cap attached to said first end of said body;

a removable second cap attached to said second end of said body, said second cap having a discharge orifice therethrough;

a chamber formed within said body between said first and second caps, wherein a lower portion of said chamber receives said material to be sprayed and in an upper portion of said chamber, between said material and said first cap, there is formed an air pocket;

an air nipple connected to said body, said air nipple having an end extending out from said body for connectin with an air supply;

air tubing located inside said body and in communication with said air nipple, said air tubing having a first portion extending to said air pocket and a second portion extending toward said second end of said body; and a control hole located near said first end of said body and in communication with said air pocket, whereby when said body is filled with material to be sprayed and air is supplied to said air tubing, said air pocket is pressurized and thereby urges said material towards said discharge orifice, and air exits said second portion of said air tubing adjacent said discharge orifice to inject air at the discharge orifice to expand and atomize the material which is being discharged.

2. The spraying apparatus of claim 1, wherein the pressure of said air pocket is controlled by means covering and uncovering said control hole.

3. The spraying apparatus of claim 1, wherein the second end of said body has a smaller diameter than said first end.

* * * * *